US007404486B2

(12) United States Patent
Smithers

(10) Patent No.: US 7,404,486 B2
(45) Date of Patent: Jul. 29, 2008

(54) MODULAR BEVERAGE CAN INTERLOCKING DEVICE

(76) Inventor: Matthew Charles Smithers, 502 Price Dr., Lewisville, TX (US) 75067

( * ) Notice: Subject to any disclaimer, the term of this patent is extended or adjusted under 35 U.S.C. 154(b) by 579 days.

(21) Appl. No.: 10/928,609

(22) Filed: Aug. 28, 2004

(65) Prior Publication Data

US 2005/0139500 A1 Jun. 30, 2005

Related U.S. Application Data

(60) Provisional application No. 60/554,163, filed on Mar. 18, 2004, provisional application No. 60/532,998, filed on Dec. 29, 2003.

(51) Int. Cl.
*B65D 75/00* (2006.01)

(52) U.S. Cl. ..... 206/427; 206/150; 206/139

(58) Field of Classification Search ..... 206/150, 206/151, 153, 427, 139; 446/77; 403/305
See application file for complete search history.

(56) References Cited

U.S. PATENT DOCUMENTS 3,250,564 A * 5/1966 Stern et al. ..... 294/87.2
3,317,087 A * 5/1967 Landis ..... 222/143
3,640,018 A * 2/1972 Light ..... 446/77
4,120,396 A * 10/1978 Mascia et al. ..... 206/151
4,582,447 A * 4/1986 Itoh ..... 403/305
5,964,343 A * 10/1999 Steiner ..... 206/203
6,021,913 A * 2/2000 McGrath ..... 220/513

* cited by examiner

*Primary Examiner*—David T. Fidei

(57) ABSTRACT

A modular beverage can interlocking device which is adapted for forming a plurality of conventional beverage cans into a building block for use as a toy or in display applications. The device generally comprises a plurality of ring-shaped members, each having an upper and lower orifice which is optimally contoured to hold the lower and upper end of a conventional beverage can respectively via at least a snug friction-fit. Preferably, the lower orifice has an inwardly facing annular slot for releasable retention of the upper lip of a conventional can via a snap-fit, and most preferably, has multiple inwardly facing annular slots of varying diameter in order to provide a snap-fit for cans of varying outer dimensions. Optional designs are provided which enable the use of thermoplastic materials having a wide range of hardnesses as well as end-cap means which provide for rigid securement to any generally flat surface.

34 Claims, 13 Drawing Sheets

MODULAR BEVERAGE CAN INTERLOCKING DEVICE

CROSS-REFERENCE TO RELATED APPLICATIONS

This application claims priority under 35 U.S.C. 119(e) on U.S. Provisional application No. 60/532,998 entitled CAN BUILDER, filed on Dec. 29, 2003, by Matthew Charles Smithers, and U.S. Provisional application No. 60/554,163 entitled CAN BUILDER, filed on Mar. 18, 2004, by Matthew Charles Smithers.

FIELD OF THE INVENTION

This invention relates generally to the field of promotional products or toys and more specifically to a system of interconnecting a plurality of beverage cans in a modular fashion. The present invention allows beverage cans to be easily assembled into combined modular units for display thereof or for building various structures such as playhouses, forts, or the like.

BACKGROUND OF THE INVENTION

It has been observed that there exists an overabundance of waste materials produced by our society and that means to re-utilize these materials, has for a large part, been overlooked. In recent years, the concept of recycling has gained momentum wherein basic consumer goods such as paper, plastic, glass, aluminum, or the like may be re-instituted into the consumer product chain, thus alleviating the load on the environment. Moreover, as we have become more of a disposable product based society, it has become more important to re-use all the materials we can and in all possible ways. Adding to this is pressure to be more responsible with our common resources, especially materials particularly lending themselves to recycling such as aluminum, paper, glass, and plastic. It has further been observed that our society produces a rather large amount of beverage cans such as those for the containment of soft drinks, beer, or other edible juices. Research has shown that as many as 156 billion cans were produced in the year of 2003 yet only 42% of these cans were recycled.

In order to provide a use for empty beverage cans, various designs have been suggested which allows a plurality of beverage cans to be releasably mounted one upon another in a modular fashion. U.S. Pat. No. 3,815,281 to Kander, U.S. Pat. No. 4,170,082 to Freedman, U.S. Pat. No. 4,474,491 to Ferrarelli, and U.S. Pat. No. 4,764,143 to Gat, et al. disclose various beverage can stacking devices having varying types of releasable retention means for the top and bottom ends of a conventional beverage can. However, all of these devices are capable of interconnecting only one can co-axially to another can; the interconnecting of additional cans which are disposed laterally relative thereto must be accomplished via complicated and cumbersome interconnect mechanisms whose retentive strength would most likely degrade due to extended use. Moreover, the interconnect mechanisms as described in the aforementioned patents do not allow a plurality of cans which are laterally interconnected relative to one another to be optimally "packed" together in order to form a building block with minimal spacing therebetween.

Another drawback is that the releasable retention means for the top and bottom portion of a conventional can as described in in the aforementioned patents is dimensioned to optimally fit only one size of can. Notwithstanding, it is well known that there are several varying styles of beverage cans, each having slightly varying dimensions, which are currently distributed in these United States. Thus, any of the aforementioned devices which has been optimally sized for use with one style of can would possibly be rendered useless with a beverage can of a different style.

Yet another drawback of the aforementioned designs is that neither device discloses a top portion can engagement member having an annular depression formed therein for resilient retainment of the lip of a top portion of a beverage can therein in conjunction with a bottom portion can engagement member for resilient friction engagement of the bottom portion of a beverage container disposed coaxially thereabove. This aspect of the prior art, by itself, reveals a salient utilitarian ramification. The can stacking device having annular depressions formed in both of the coaxially disposed can engagement members would only optimally retain the top portion of a conventional can, thus inverting the longitudinal orientation of the proceeding can therebeneath thereby hindering the ability to stack successive cans above or below in an optimal manner. Moreover, can stacking devices having hollow, cylindrically shaped members formed in both of the coaxially disposed can engagement members would not employ the enhanced releasable securing feature of an annular depression for optimal retainment of the lip portion of a conventional can therein.

SUMMARY OF THE INVENTION AND OBJECTIVES

In accordance with the present invention, there is disclosed a modular beverage can interlocking device comprising a plurality of ring-shaped devices, wherein each ring-shaped device has an upper orifice and a lower orifice which provides reliable retention means for the bottom end and top end of a conventional beverage can respectively in a substantially co-axial orientation. A plurality of fillets interconnect said plurality of ring-shaped devices in a generally co-planar orientation thereby allowing a plurality of said beverage cans to be interconnected side-by-side with respect to each other, such that when the lower orifices of each of said plurality of ring-shaped member are populated with said plurality of beverage cans, a modular style building block is formed which is adapted for stacking, one upon another.

Preferably, the ring-shaped members are disposed in at least one column of multiple evenly spaced linear rows whereby the interlocking device having the lower orifices of the ring-shaped members thereof populated with cans forms a generally rectangular shaped block which is easily interconnected with other populated interlocking devices. Additionally, means are described to allow the usage of varying styles or sizes of beverage cans via multiple inwardly facing annular slots of differing diameter, which are adapted to engage the lip of said can therein.

Thus a primary object of the present invention is to provide a means of promoting cans to be recycled into productive useful items.

Another object of the present invention is to provide a means of connecting cans into a repeatable functional unit of building.

Another object of the present invention is to provide a creative promotional item for shipping and selling of liquids in cans.

A further object of the present invention is to provide a means of displaying can collections in a organized manner.

Another object of the present invention is to provide a modular style beverage can interlocking device which obviates the disadvantages of the prior art while providing a device which is inexpensive to manufacture, and thus inexpensive to the end user.

Other objects and advantages of the present invention will become apparent from the following descriptions, taken in connection with the accompanying drawings, wherein by way of illustration and example, preferred embodiments of the present invention are disclosed.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
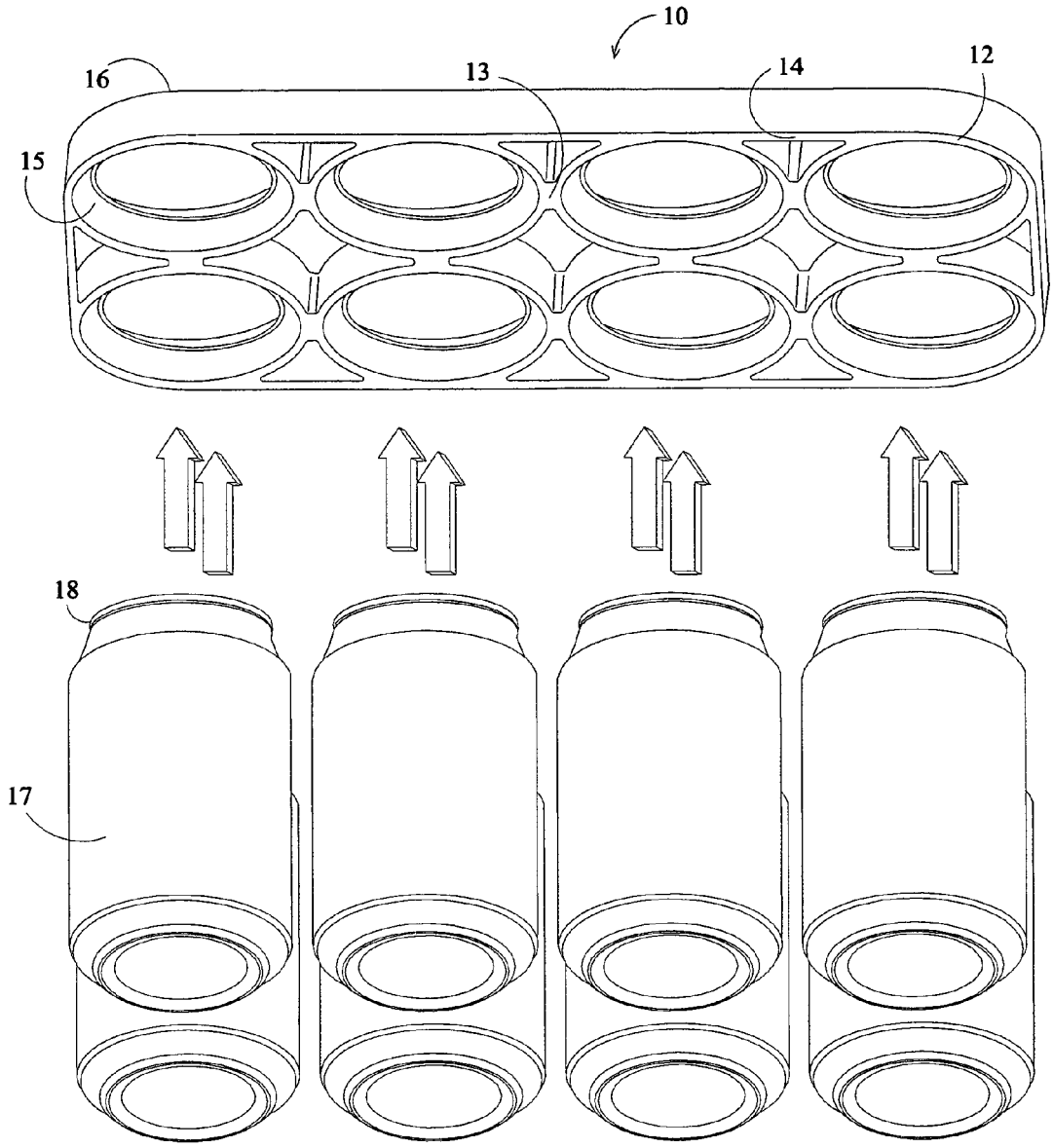
FIG. 1 is a perspective view of one embodiment according to the present invention shown with eight conventional beverage cans properly oriented for releasable insertion into the lower orifice of each of the ring-shaped members.
Figure 2:
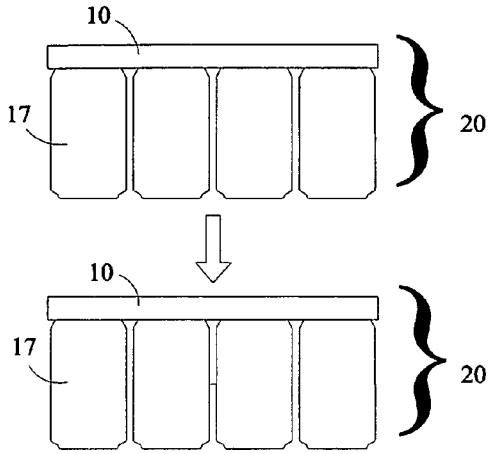
FIG. 2 is a front elevational view of two devices according to the embodiment of FIG. 1 which have been populated with conventional cans, thereby forming two building blocks. As shown, one building block is properly oriented over the other for releasable securement thereto.
Figure 3:
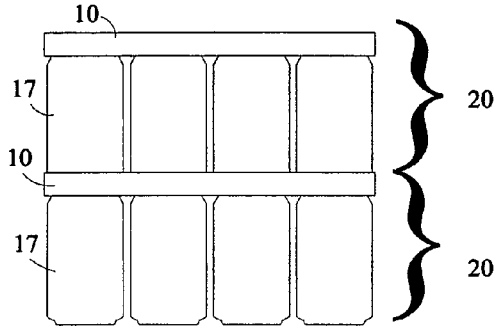
FIG. 3 is a front elevational view of the embodiment of FIG. 2, wherein the two building blocks are releasably secured to each other. It is to be understood that other building blocks may be subsequently stacked above or below the two displayed building blocks in a similar manner.
Figure 6:
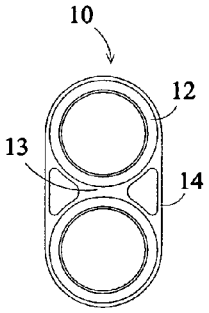
FIG. 6 is a plan view of the embodiment of FIG. 1 shown having only one column of two rows of ring-shaped members.
Figure 7:
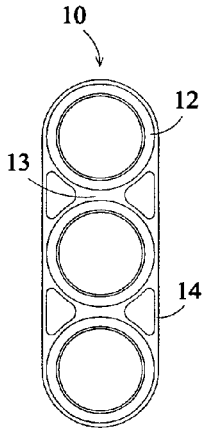
FIG. 7 is a plan view of the embodiment of FIG. 1 shown having only one column of three rows of equally spaced ring-shaped members.
Figure 8:
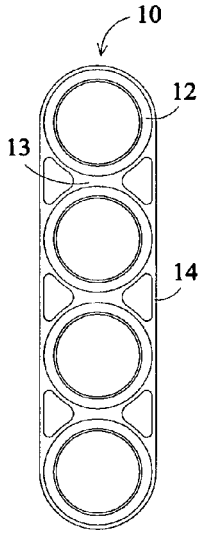
FIG. 8 is a plan view of the embodiment of FIG. 1 shown having only one column of four rows of equally spaced ring-shaped members.

As shown in FIGS. 1 through 10, a modular beverage can interlocking device embodying a preferred embodiment of a device according to the instant invention is designated generally by the reference numeral 10. The beverage can interlocking device 10 is generally shown in FIG. 1 having a plurality of ring-shaped or generally cylindrically-shaped members 12 interconnected via integrally formed inner fillets 13 and optional outer fillets 14, wherein the outer fillets tangentially interconnect each of the ring-shaped members thus forming a part of the outer periphery thereof. All the members 12 are substantially co-planar in orientation having a lower orifice 15 and an upper orifice 16. The lower orifice 15 is adapted for the releasable securement of the upper portion of a conventional beverage can 17 thereinto and conversely the upper orifice 16 is adapted for the insertion of the bottom portion of another beverage can thereinto. Thus the lower orifices 15 of the device 10 may be populated with preferably empty beverage cans in order to form a modular style building block which are maintained in a reasonably rigidly secure structural relation to each other. As shown in FIG. 2, additional interlocking devices 10 may also be populated with beverage cans in order to form a plurality of building blocks 20 that are adapted to be stacked upon each other in order to create visual displays of the beverage cans or as a toy to challenge the creative ability of young children.

Figure 5:
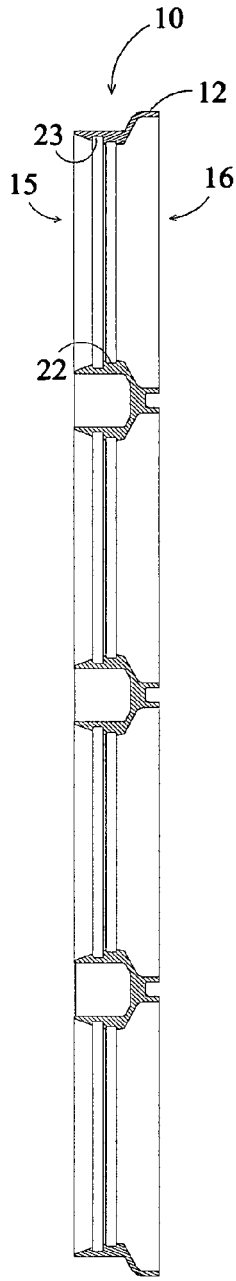
FIG. 5 is an elevational cut-away view of the embodiment of FIG. 4 taken along the line 5-5 shown having two inwardly facing annular slots of varying diameter.

Retaining means for the upper portion of each can 17 is provided by the lower orifice 15 as shown in FIG. 5, of each ring-shaped member 12 via two integrally formed annular slots (22 and 23) formed on the inner sufface thereof, thereby providing a snap-fit for the lip 18 as shown in FIG. 1 thereof. As best shown in FIG. 5, the preferred embodiment incorporates the use of two slots of varying diameter in order to enable the use thereof on differing types of beverage cans having variable outer lip dimensions. Nevertheless, it is to be understood that the present invention may also be practiced with a lower orifice 15 having only one annular slot or even more than two annular slots, in fact, no slots may be used if the can is to be releasably retained in the lower orifice 15 using a snug friction-fit. Conversely, the upper orifice 16 of each of the ring-shaped members 12 is dimensioned to releasably secure the bottom portion of a conventional beverage can 17 via a snug friction-fit. As best shown in FIG. 5, the upper orifice 16 which is preferably optimally shaped to conform to the contour of the bottom portion of a conventional beverage can operates in conjunction with the resiliency of the ring-shaped members to provide a reasonable interlocking force for a beverage can disposed therein.

The device 10 is formed from a resilient thermoplastic exhibiting sufficient resiliency to allow for slight deformation thereof during insertion of the beverage can. The device 10 may be formed of any known thermoplastic material having sufficient resiliency to allow for slight deformation thereof during insertion of the beverage can thereinto. The preferred material used for forming the present embodiment was polyurethane, having a hardness from 95 shore A as measured by ASTM (American Society for Testing and Materials); however, it is to be understood by those skilled in the art that there are numerous types of thermoplastic formulations having varying hardnesses which would be suitable for this purpose.

Figure 9:
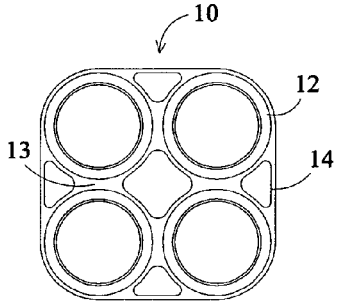
FIG. 9 is a plan view of the embodiment of FIG. 1 shown having two columns of two rows of equally spaced ring-shaped members.
Figure 4:
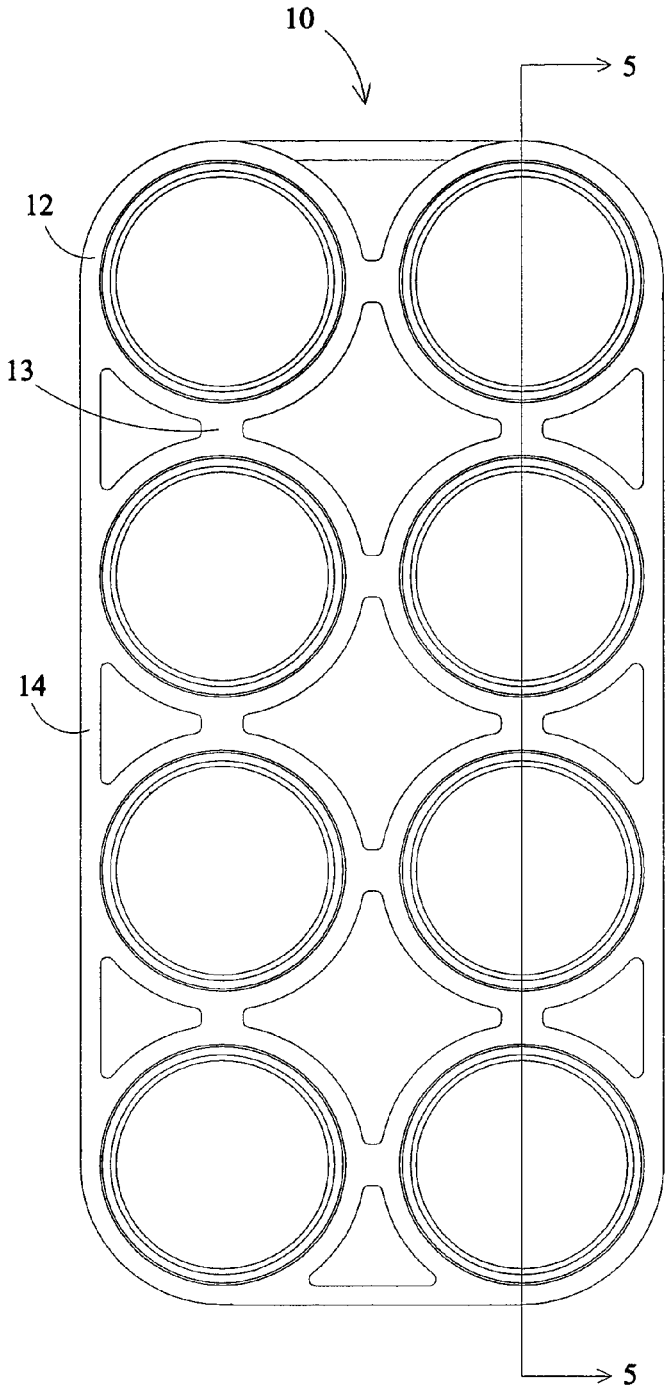
FIG. 4 is a plan view of the embodiment of FIG. 1 shown having two columns of four rows of equally spaced ring-shaped members.

The modular beverage can interlocking device of the present embodiment is shown having a total of eight ring-shaped members 12 which are integrally formed from one piece into two columns of equally spaced linear rows having four members 12 thus forming a two-by-four type configuration; however, other types of integrally formed configurations are possible including a one-by-two configuration, a one-by-three configuration, a one-by-four configuration, or even a two-by-two configuration as shown in FIGS. 6, 7, 8, and 9 respectively. Nevertheless, it is to be appreciated that virtually any type of configuration could be realized including two-by-five, three-by-six, and the like using the concepts and teachings of the present invention. Additionally, it is contemplated that that other geometric configurations such as three ring-shaped members 12 disposed equilaterally apart and maintained in a generally co-planar relation to each other by fillets thereby forming a triangular shape would also be a valid alternative. A further novel concept of the present invention is the ability to severe the inner 13 and outer 14 fillets which may be selectively cut by a user using a saw or knife in order to split the interlocking device 10 into a plurality of smaller interlocking devices. For example, an interlocking device 10 having a two-by-four configuration may be split by a user into two devices, each having a two-by-two configuration as depicted in FIG. 9.

Figure 10:
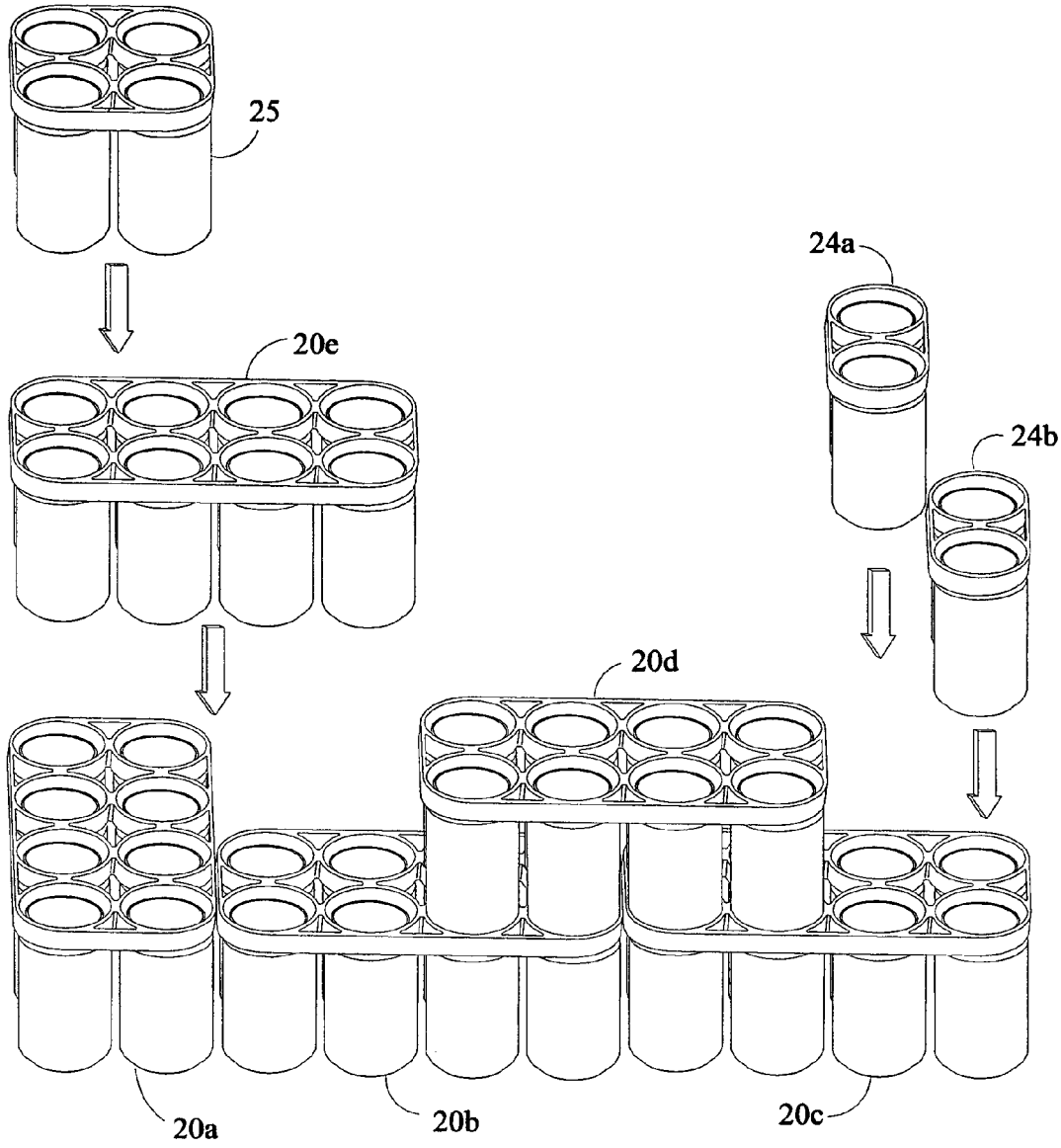
FIG. 10 is a perspective view of a plurality of devices of varying configuration according to the embodiment of FIG. 1 shown in the proper orientation for stacking one upon another.

FIG. 10 depicts how building blocks of various configurations may be intermingled in order to form a structure, wherein the type of structure formed therewith is limited only by the user's creative ability. As shown, building blocks 20*a*, 20*b*, and 20*c* form a base for the subsequent placement of other building blocks thereupon. Block 20*d* is placed over blocks 20*b*, and 20*c* in a "straddling" fashion such that the overall structural integrity of the overall structure is enhanced. Block 20*e* placement straddles both blocks 20*a*, and 20*b* in such a manner to create a bend or corner in the user created structure. Additionally, building blocks having other configurations may also be interconnected to the structure such as building blocks 24*a*, and 24*b* having a one-by-two configuration and building block 25 having a two-by-two configuration.

Figure 11:
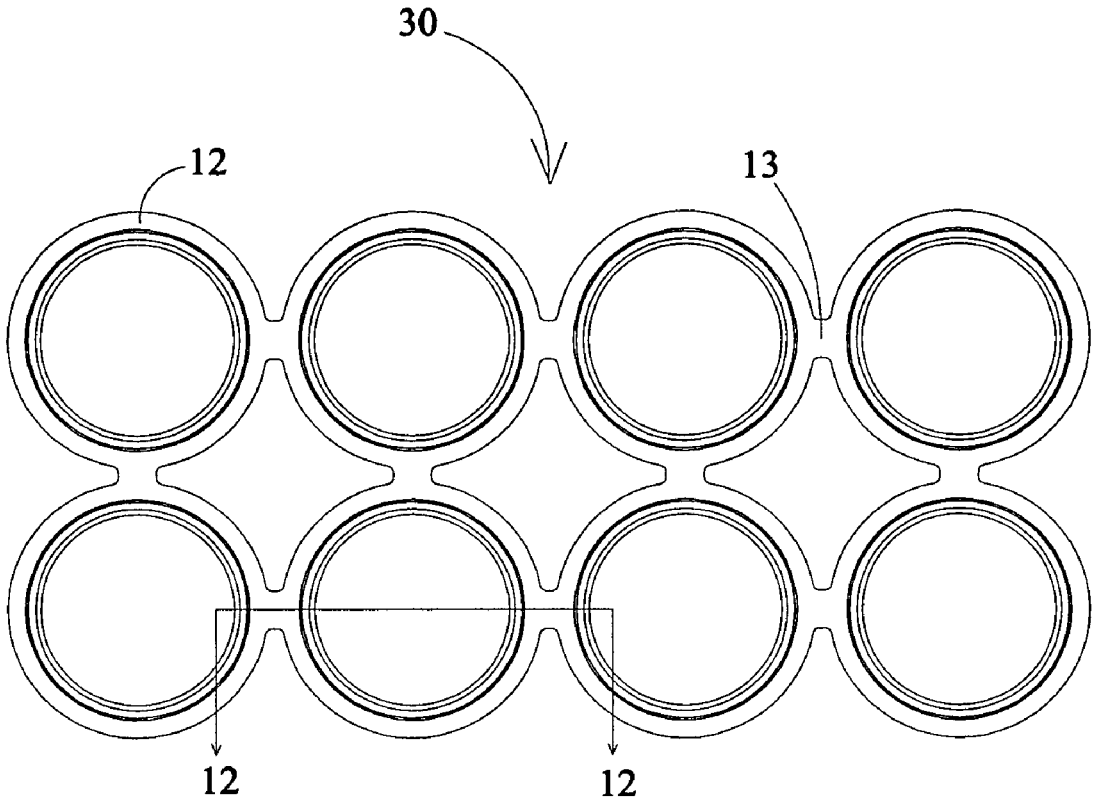
FIG. 11 is an alternative embodiment of the present invention wherein no outer fillets exist on the outer periphery thereof.
Figure 12:
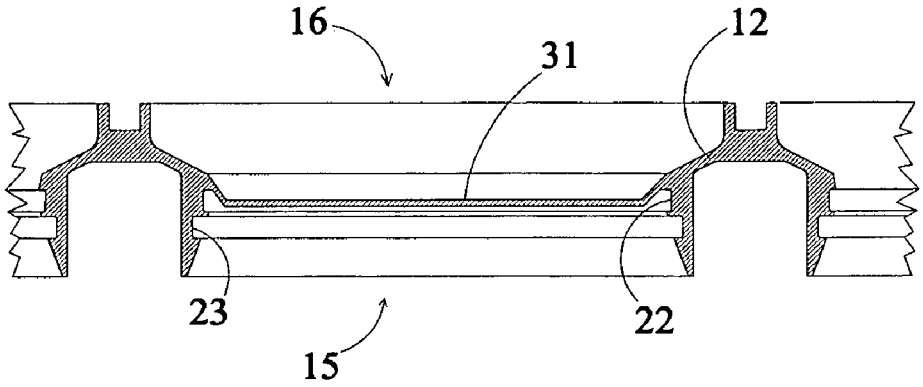
FIG. 12 is an enlarged elevational cut-away view of the embodiment of FIG. 11 taken along the line 12-12 shown having a disk-shaped membrane which isolates the upper orifice from the lower orifice.

It is important to note that although the outer fillets 14 do provide a relatively more finished aesthetic appeal to the device 10, they are not necessary for enabling the practice of the present invention. FIG. 11 shows an alternative embodiment 30 of the present invention that is void of outer fillets 14. The ring-shaped members 12, inner fillets 13, and inwardly facing annular rings (22 and 23) are similar in design and purpose to the embodiment of FIGS. 1 through 10. The present embodiment 30 differs however in that no fillets 14 exists around its outer periphery. An additional variation is that each ring-shaped member 12 has a disk-shaped membrane 31 integrally attached around the inner periphery thereof in order to isolate and seal the contents of the cans 17 disposed in the lower orifices 15 thereof as best shown in FIG. 12. Thus, liquid which has been inadvertently left in the beverage can prior to securement into the lower orifice 15 is prevented from spillage.

Figure 13:
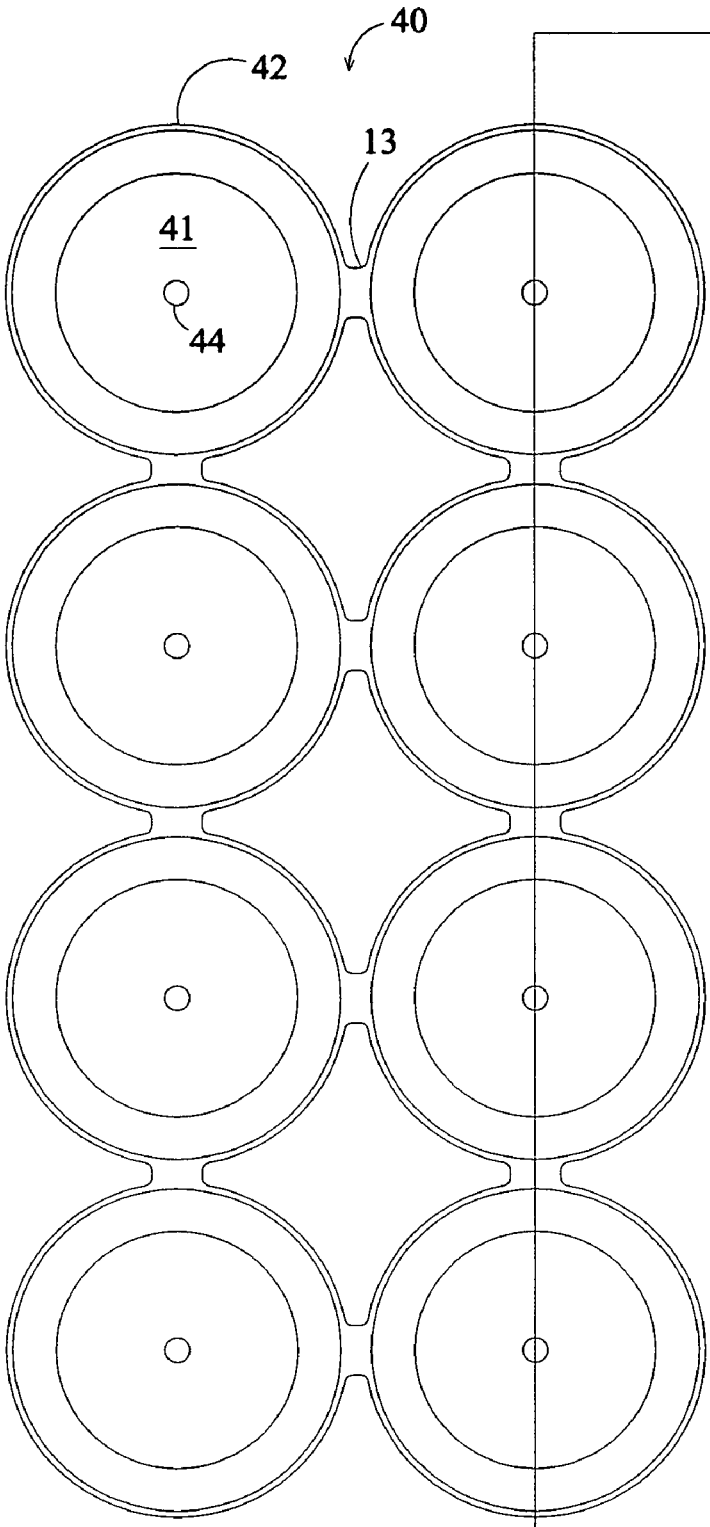
FIG. 13 is a plan view of another alternative embodiment according to the present invention shown having disk-shaped end-caps formed on the lower orifice of each of the ring-shaped members.
Figure 14A:
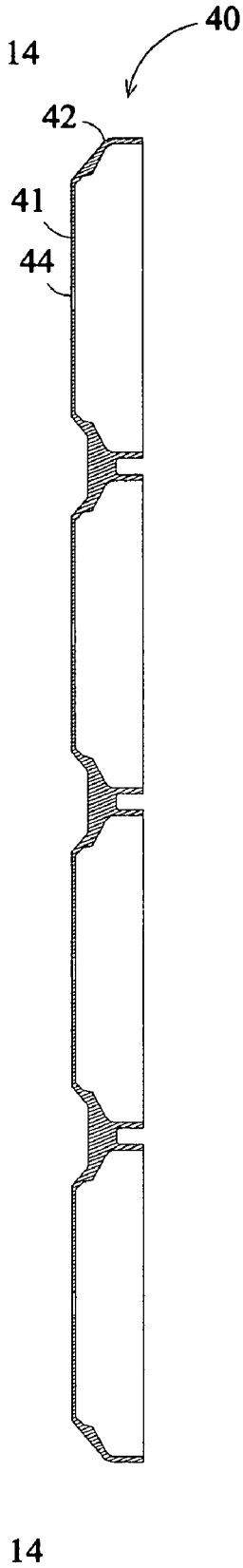
FIG. 14A is an elevational cut-away view of the embodiment of FIG. 13 taken along the line 14-14 shown having a disk-shaped end-cap integrally attached to the lower orifice of each of the ring-shaped members, wherein each end-cap has a screw hole centrally disposed therein.
Figure 14B:
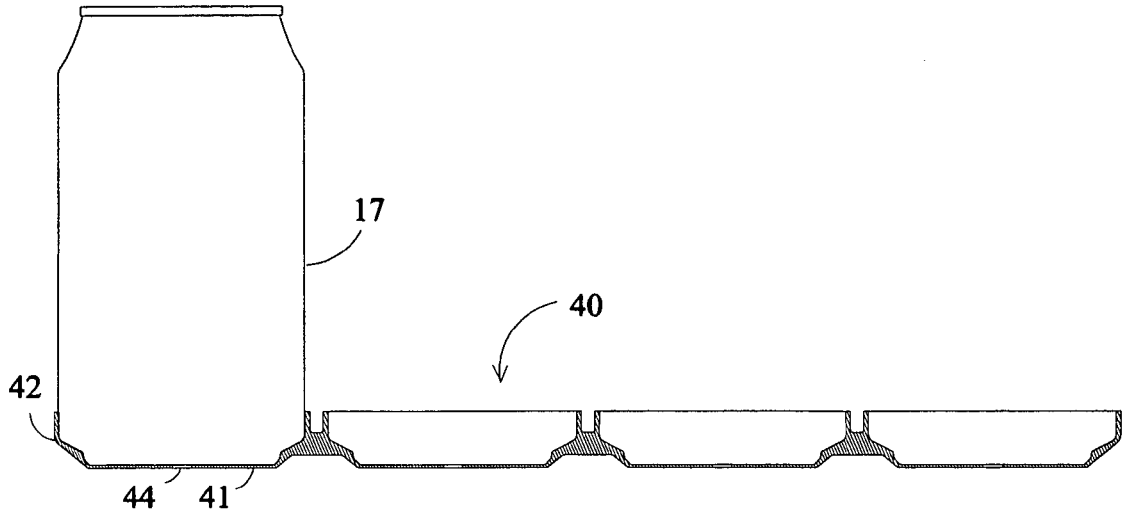
FIG. 14B is an elevational cut-away view of the embodiment of FIG. 13 taken along the line 14-14 showing one can disposed in the upper orfice of one ring-shaped member.

Another alternative embodiment 40 of the present invention as shown in FIGS. 13, 14A, and 14B presents a modular beverage can interlocking device which is adapted for releasable engagement of only of the bottom portion of a conventional beverage can, wherein the device 40 also has mounting means for securement to any generally flat surface such as a countertop or table. The interconnecting inner fillets 13 and the possible configurations available therewith, are similar in design and purpose to the embodiment of FIGS. 1 through 10. Although the present embodiment may successfully be practiced with the addition of outer fillets 14, the use thereof in not included in the present embodiment. Mounting means is provided by disk-shaped end-caps 41 formed on the lower orifice of each of the ring-shaped members 42 and integrally attached around the annular extent thereof. Screw holes 44 are centrally disposed in each of the end-caps 41 and are sized to accept any standard sized screw therein, preferably a #8 sized screw. Thus, the device 40 enables rigid securement of any structure created by the aforedescribed building blocks to any generally flat surface. FIG. 14B shows a cross-sectional view of the device 40 having the bottom portion of one can 17 disposed therein.

Figure 16B:
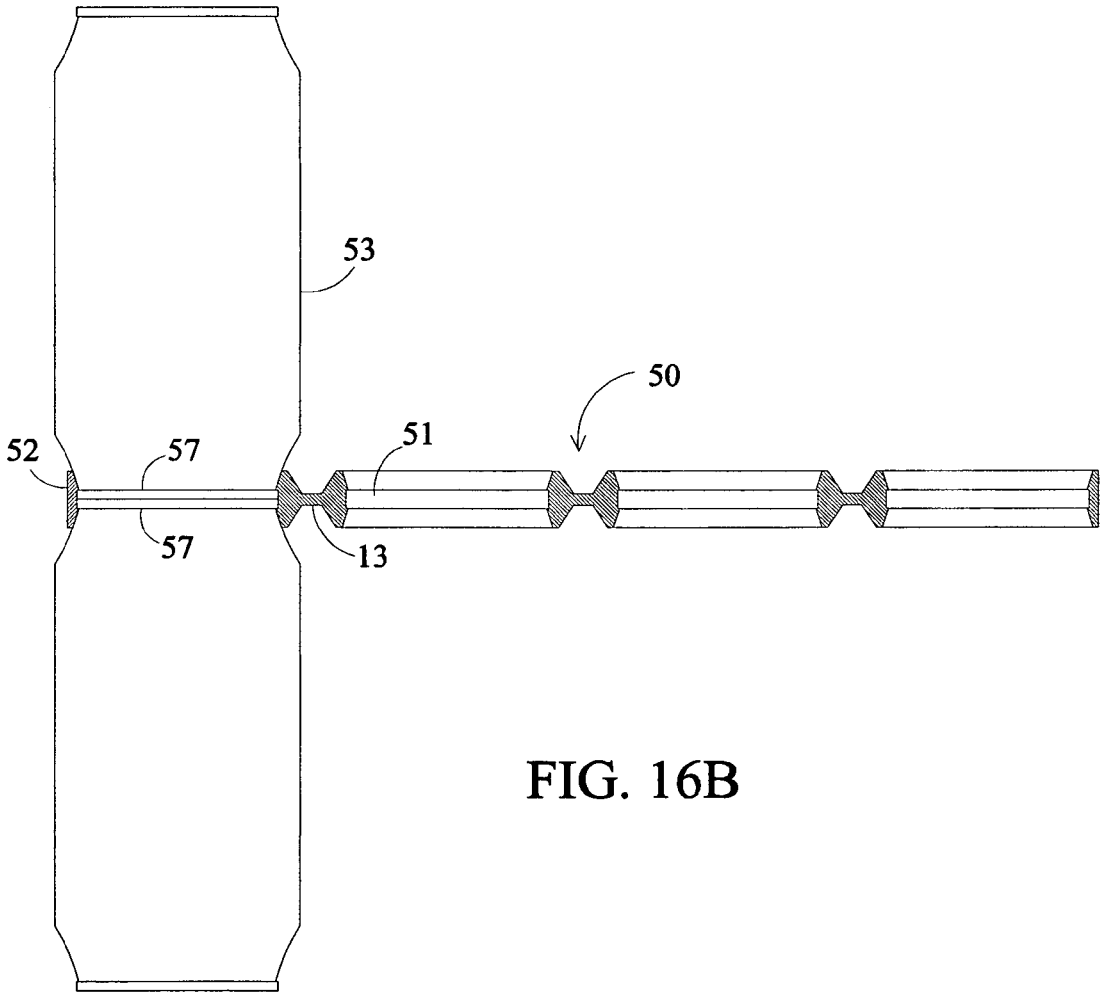
FIG. 16B is is an elevational cut-away view of the embodiment of FIG. 15 taken along the line 16-16 shown having two cans co-axially disposed in the upper and lower orifices of one of the ring-shaped members.
Figures 15, 16A:
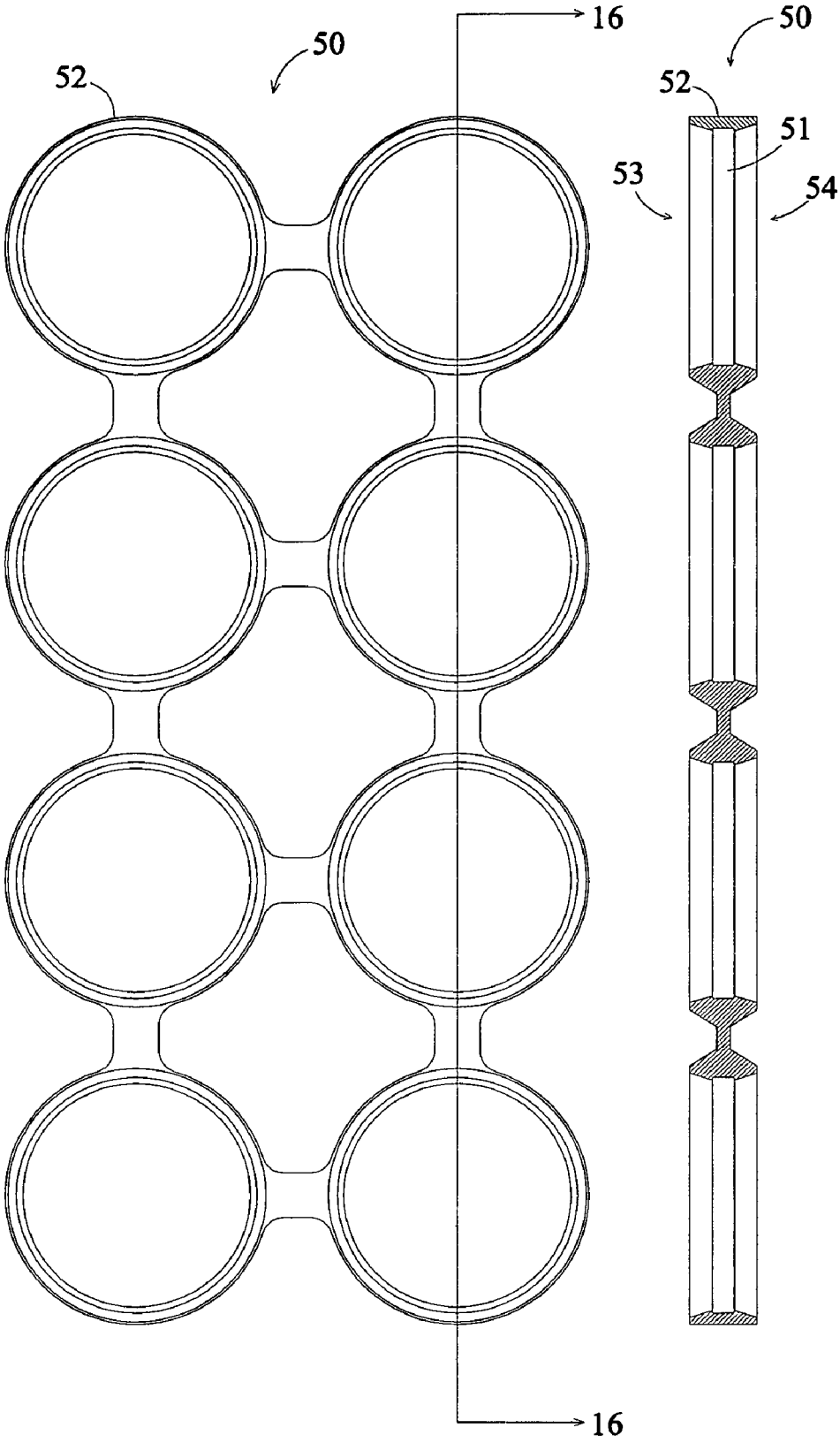
FIG. 15 is a plan view of another alternative embodiment according to the present invention wherein both the upper and lower orifices of the ring-shaped member are adaptable to provide a snap-fit for a conventional can therein.
FIG. 16A is an elevational cut-away view of the embodiment of FIG. 15 taken along the line 16-16 shown having a slot in each of the ring-shaped members which is optimally sized to allow placement of the lips of both cans which are disposed in the lower and upper orifices thereof via a snap-fit.
Figure 17:
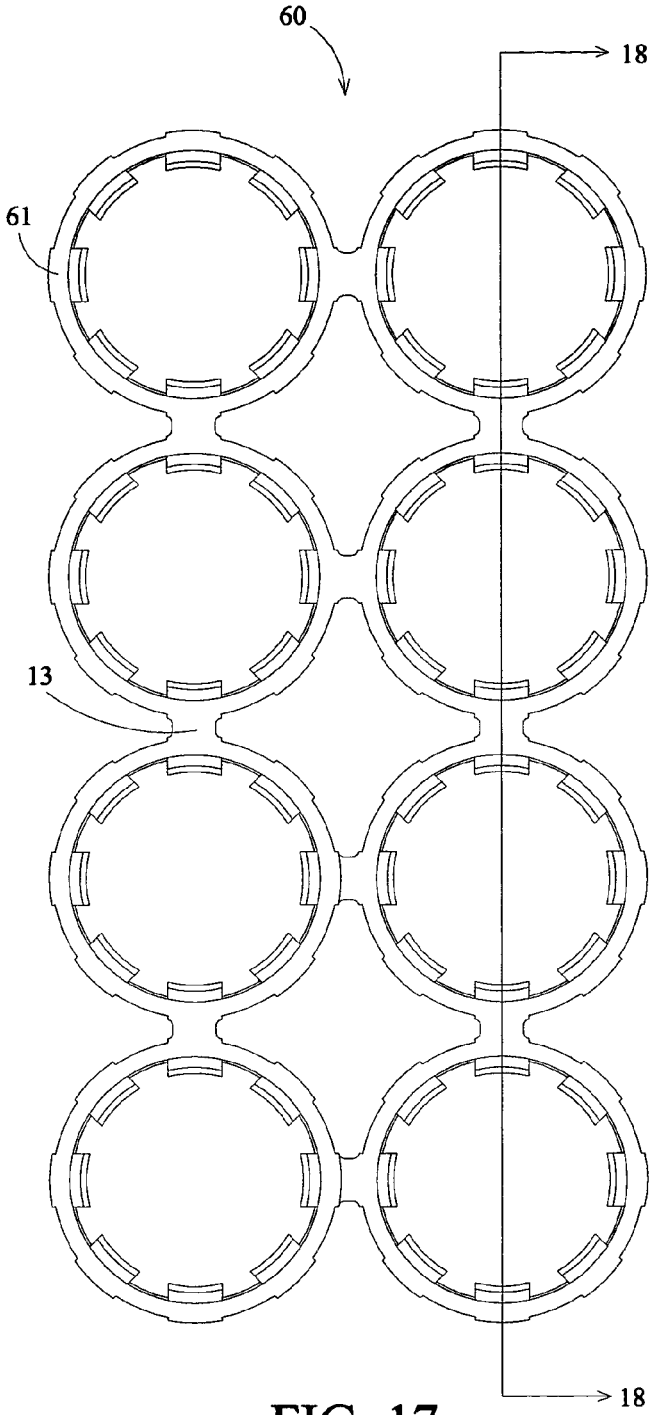
FIG. 17 is a plan view of another alternative embodiment according to the present invention shown having gaps in the upper and lower portions of each of the ring-shaped members thereby enabling the use of thermoplastic material having a higher relative hardness.
Figure 18A:
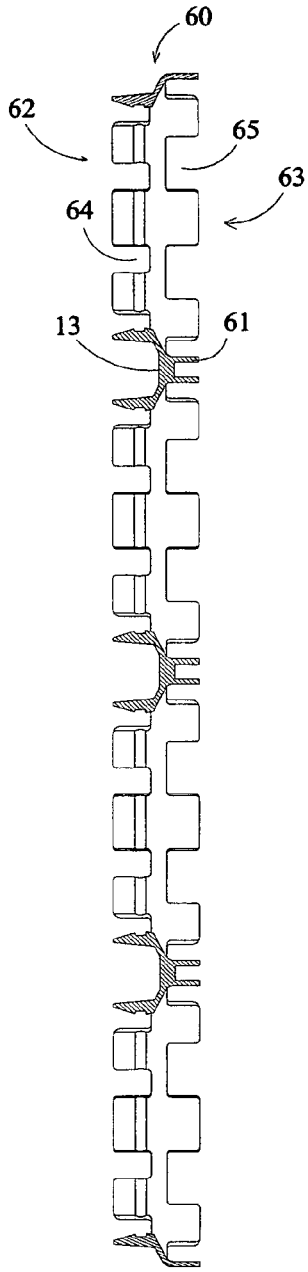
FIG. 18A is an elevational cut-away view of the embodiment of FIG. 17 taken along the line 18-18 shown having only one inwardly facing annular slot.
Figure 18B:
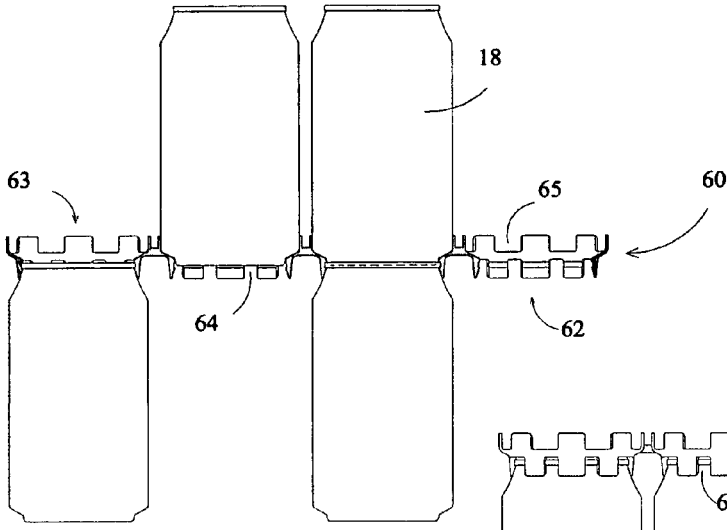
FIG. 18B is an elevational cut-away view of the embodiment of FIG. 17 taken along the line 18-18 shown partially populated with conventional cans.

Yet another alternative embodiment 50 of the present invention is shown in FIGS. 15, 16A, and 16B wherein both the upper 54 and lower 53 orifices of the ring-shaped member 52 are adapted to provide a snap-fit for a conventional can. The present embodiment 50 is particularly suited for use with cans 53 having lips 57 at the top as well as bottom thereof or when the user wishes to juxtapose the top portion of cans in the lower orifice 53 adjacent to the top portion of other cans in the upper orifice 54. The interconnecting inner fillets 13, as well as the possible configurations available therewith, are similar in design and purpose to the embodiment of FIGS. 1 through 10. Although the present embodiment may successfully be practiced with the addition of outer fillets, the use thereof in not included in the present embodiment. The present embodiment 50 differs however in that a single annular slot 51 is disposed of the inner surface of each of the ring-shaped members 52. As shown in FIG. 16B, the slot 51 is optimally sized to allow placement of the lips 57 of both cans 53 which are disposed in the lower 53 and upper 54 orifices via a snap-fit.

Another alternative embodiment 60 of the present invention incorporates the use of a plurality of gaps (64 and 65) formed in the lower as well as upper portion in each of the ring-shaped members 61 in order to enable the use of thermoplastic material having increased hardness. The interconnecting inner fillets 13 and thus the possible configurations available therewith, are similar in design and purpose to the embodiment of FIGS. 1 through 10. Although the present embodiment may successfully be practiced with the addition of outer fillets 14, the use thereof in not included in the present embodiment. Additionally, each of the ring-shaped members 61 has an upper 63 and lower 62 orifice which is adapted for releasable retention of the lower and upper portion of a beverage can 17 respectively, is similar in purpose to the embodiment of FIGS. 1 through 10. However, each of the ring-shaped members 61 of the current embodiment differs in that a plurality of gaps (64 and 65) exists in the lower and upper portions of each of the ring-shaped members 61. The gaps, which are integrally formed in the upper and lower portions of the ring-shaped member, serve to increase the effective pliability of the upper orifice as well as lower orifice, thereby reducing the relative insertion force required for releasable placement of a beverage can thereinto. Thus, the incorporation of gaps (64 and 65) in conjunction with a thermoplastic material having a higher relative hardness than used in the previous embodiment value renders upper and lower orifices having acceptable resiliency. Using the design of the present embodiment, it is contemplated that thermoplastic materials having a hardness of up to approximately 80 shore D may be effectively utilized in the manufacture thereof.

Figure 19:
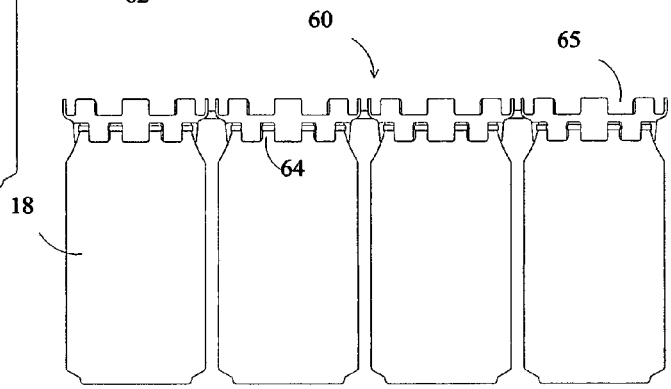
FIG. 19 is a front elevational view of the embodiment of FIG. 17 shown with all of the lower orifices of the ring-shaped members populated with conventional beverage cans.
Figure 20:
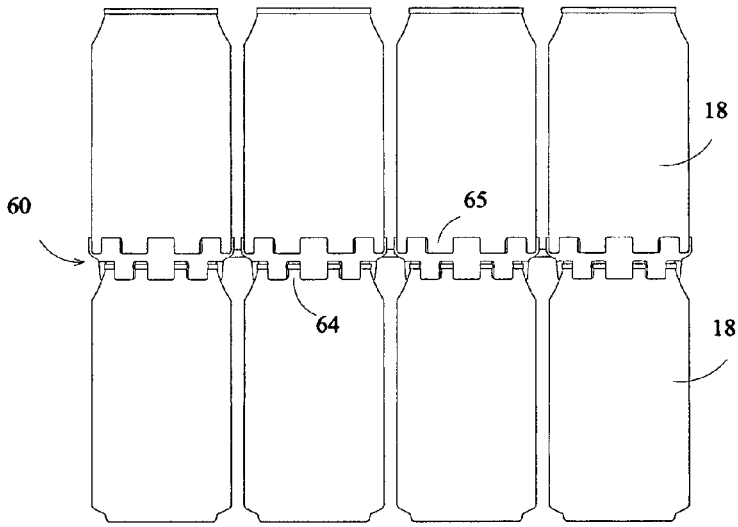
FIG. 20 is a front elevational view of the embodiment of FIG. 17 shown with all of the lower orifices as well as the upper orifices of the ring-shaped members populated with conventional beverage cans.

As shown in FIGS. 17 through 20, the modular beverage can interlocking device 60 is shown having a two-by-four type configuration. Nevertheless, it is to be understood that other configurations such as one-by-four, two-by-three, one-by-six, and the like are possible using the present design. A plurality of upper portion gaps 65 are formed in the upper portion of the ring-shaped member 61 and conversely, a plurality of lower portion gaps 64 are integrally formed in the lower portion of the ring-shaped member. FIG. 18B shows the arrangement of the device 60 in relation to several cans 17 which have been inserted thereonto. As can be seen, the present invention provides a means of interconnecting a plurality of cans in an optimally dense manner thus forming building blocks which are more structurally robust than heretofore realized by the prior art. FIG. 19 depicts a device 60 having all of the lower orifices 64 thereof entirely populated with beverage cans 17 and FIG. 20 depicts a device 60 having all of the lower orifices 64 in addition to all of the upper orifices 65 populated with beverage cans.

Figure 21:
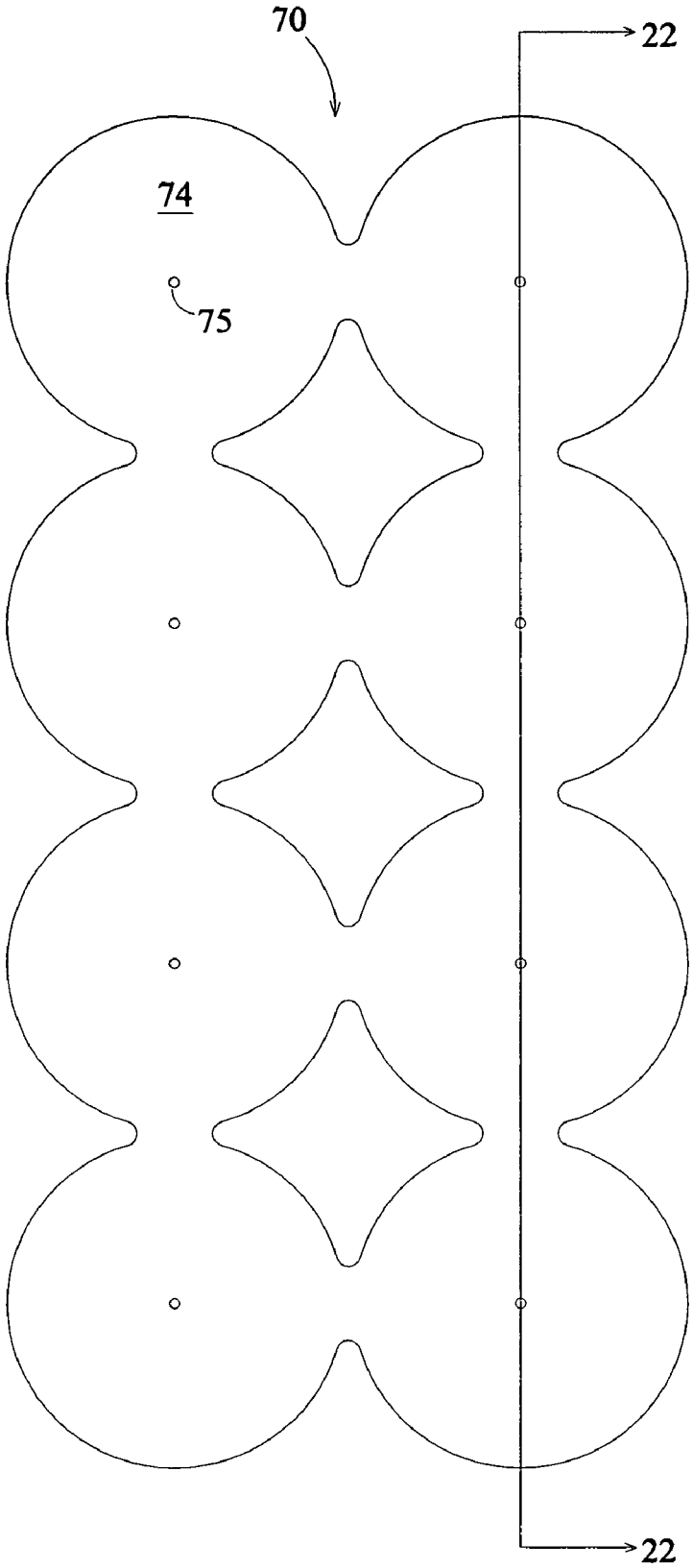
FIG. 21 is a plan view of another alternative embodiment according to the present invention shown having disk-shaped end-caps integrally attached to the upper orifice of each of the ring-shaped members.
Figure 22A:
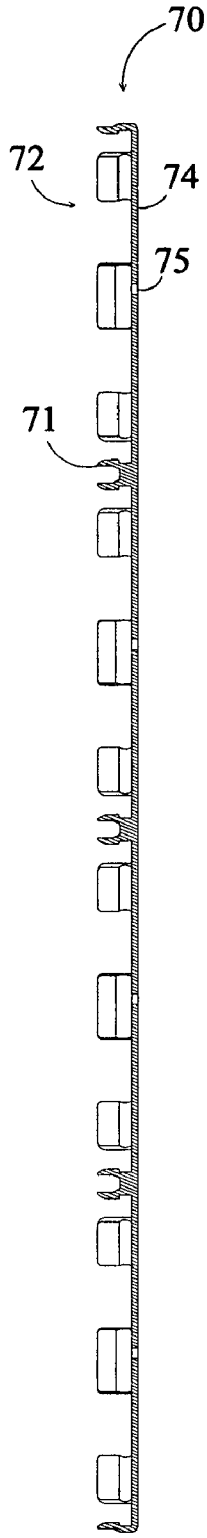
FIG. 22A is an elevational cut-away view of the embodiment of FIG. 21 taken along the line 22-22 shown having a disk-shaped end-cap integrally attached to the upper orifice of each of the ring-shaped members, wherein each end-cap has a screw hole centrally disposed therein.
Figure 22B:
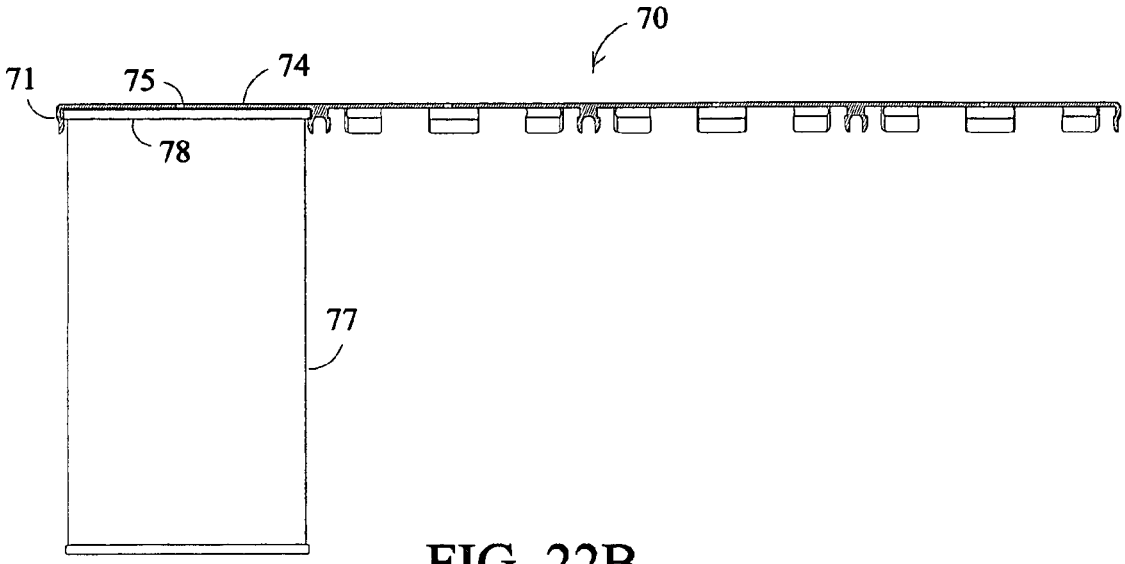
FIG. 22B is an elevational cut-away view of the embodiment of FIG. 21 taken along the line 22-22 showing one can disposed in the lower orfice of one of the ring-shaped members.
Figure 24B:
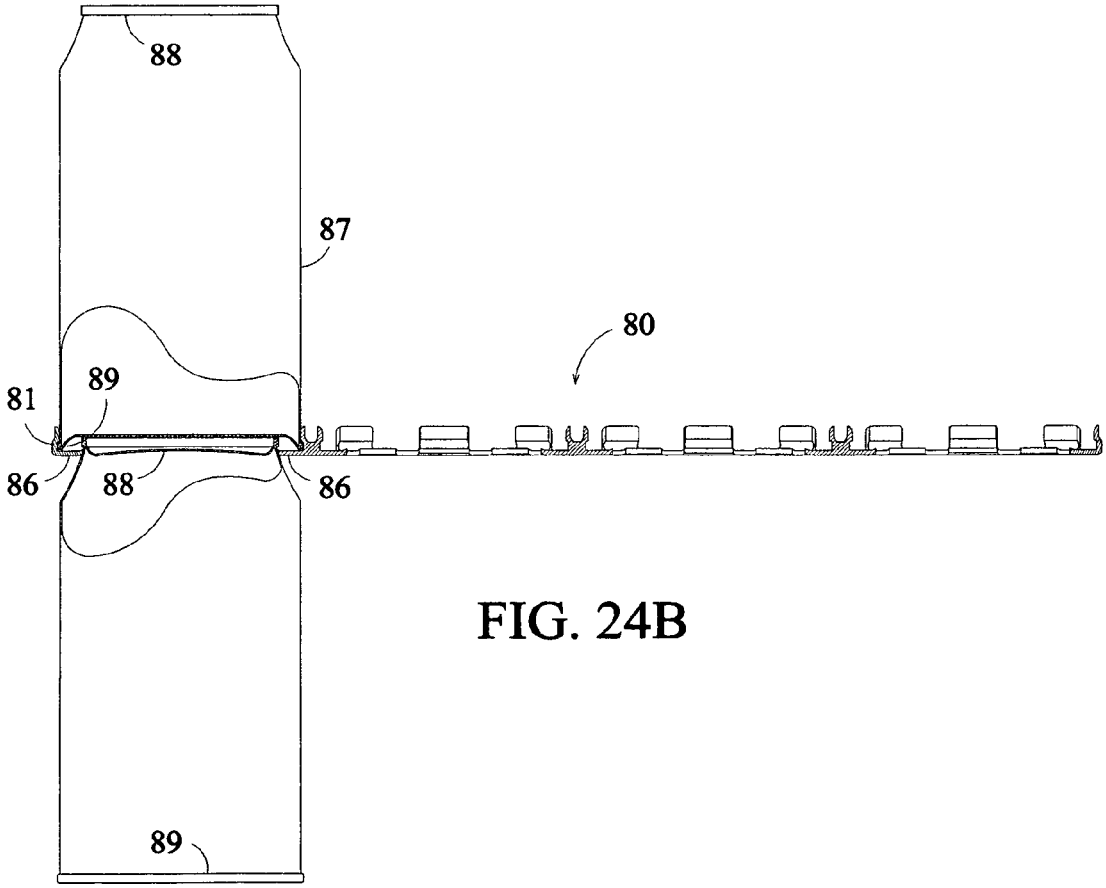
FIG. 24B is an elevational cut-away view of the embodiment of FIG. 23 taken along the line 24-24 shown having two cans co-axially disposed in the upper and lower orifices of one of the ring-shaped members.

Yet another alternative embodiment 70 of the present invention presents a modular beverage can interlocking device which is adapted for releasable engagement of only of the portion of a conventional beverage can having a lip on the upper or lower end portion thereof. The device 70 also has mounting means for optional securement to any generally flat surface, preferably a surface which faces downwards in order to allow cans, which have been engaged thereupon, to depend from the flat surface. The interconnecting inner fillets 13, and the possible configurations available therewith, are similar in design and purpose to the embodiment of FIGS. 17 through 20. Additionally, each of the ring-shaped members 71 has a lower orifice 72, which is adapted for releasable retention of the upper portion lip 78 of a beverage can 77, is similar in purpose to the embodiment of FIGS. 17 through 20. The device 70 of FIGS. 21, 22A, and 22B differ however in that mounting means are provided by disk-shaped end-caps 74 formed on the upper orifice 72 of each of the ring-shaped members 71 and integrally attached around the annular extent thereof. Screw holes 75 are centrally disposed in each of the end-caps 74 and are sized to accept any standard sized screw therein, preferably a conventionally available #8 sized screw. FIG. 22B shows the structural relationship of a can 77, having a lip 78 on the upper portion thereof, releasably engaged in one of the ring-shaped members 71.

Figure 23:
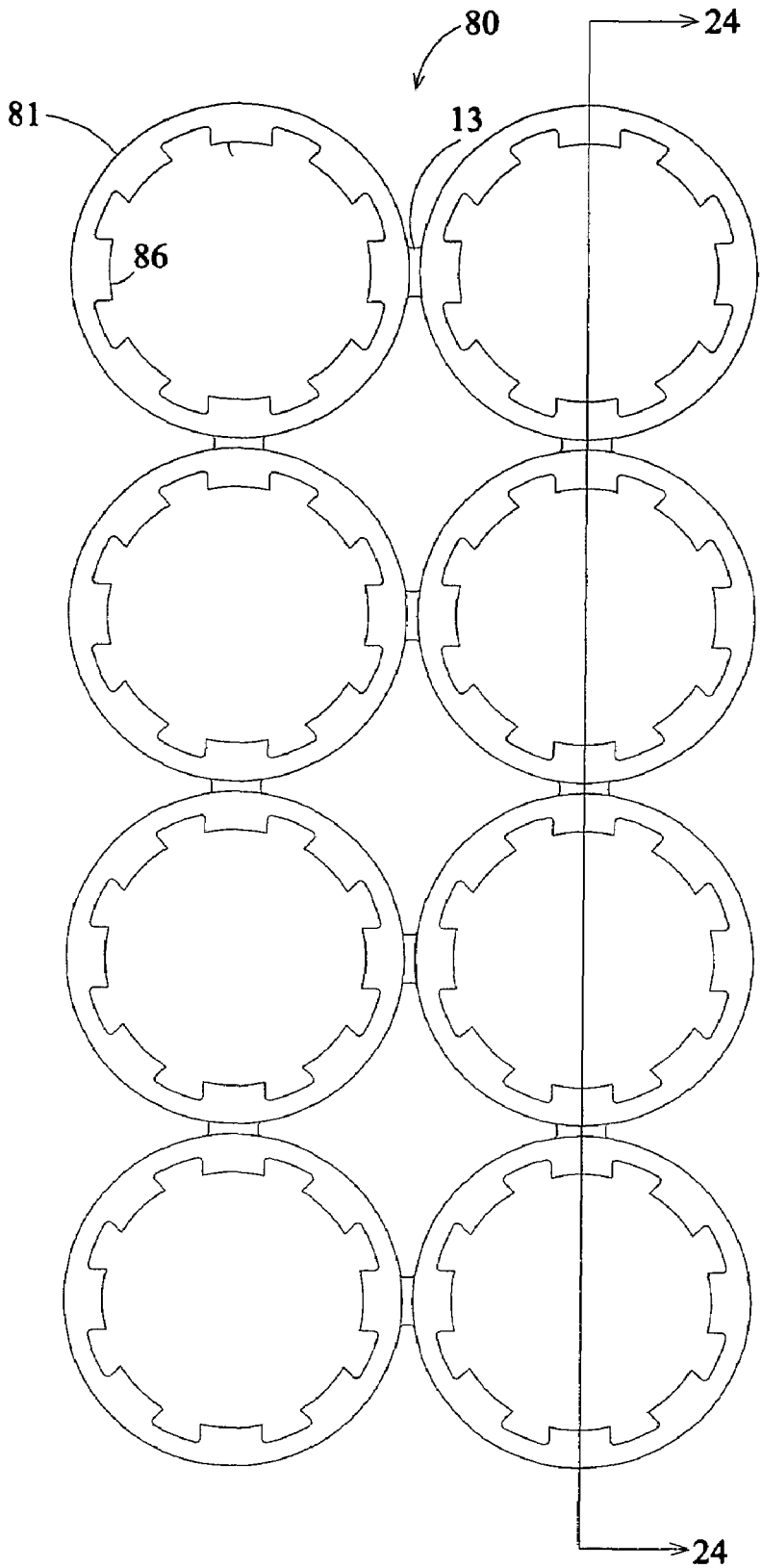
FIG. 23 is a plan view of another alternative embodiment according to the present invention which enables the interconnection of cans having lips on the upper as well as lower portions thereof.
Figure 24A:
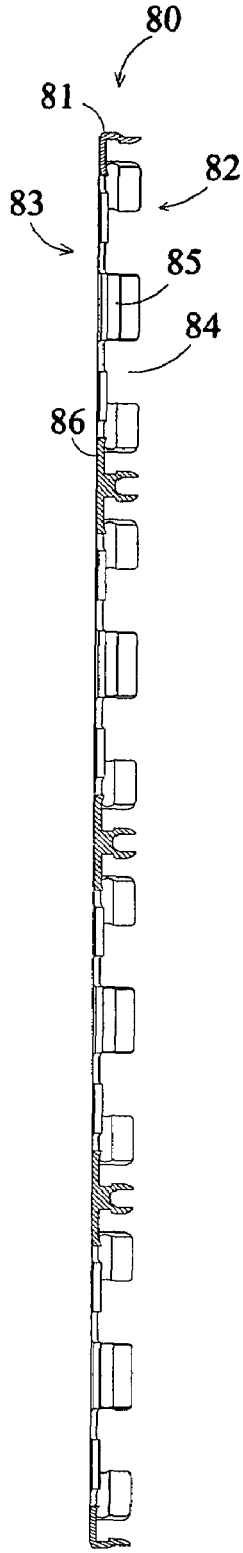
FIG. 24A is an elevational cut-away view of the embodiment of FIG. 23 taken along the line 24-24.

Another alternative embodiment 80 of the present invention enables the interconnection of cans 87 having an upper portion lip 88 as well as a lower portion lip 89, wherein the upper portion lip 88 is smaller in diameter than the lower portion lip 89. Although cans 87 of this type do afford some modicum of stability when stacked one upon another, the device 80 greatly enhances the structural integrity of these cans 87 when stacked one upon another by providing retaining means for the upper and lower portion lips (88 and 89) thereof via a snap fit. The interconnecting inner fillets 13 and thus the possible configurations available therewith, are similar in design and purpose to the embodiment of FIGS. 17 through 20. Additionally, each of the ring-shaped members 81 has an upper orifice 82 with gaps 84 formed therein, which is adapted for releasable retention of the lower portion of a beverage can 87, is similar in purpose to the embodiment of FIGS. 17 through 20. However, the present embodiment differs in that the upper orifice 82 has a annular slot 85 for snap-fit engagement of the lower portion lip 89 of the can 87. Additionally, the lower orifice 83 of each ring-shaped member 81 has a plurality of tabs 86, which are integrally attached around the annular extent thereof, project inwardly to releasably retain the upper portion lip 88 of the can. FIG. 23B shows an elevational, cross-sectional view of the device 80 depicting the structural relationship of two cans 87 releasably engaged in one of the ring-shaped members 81.

While the invention has been described in connection with only several preferred embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A modular beverage can interlocking device adapted for releasable retention of a plurality of conventional beverage cans wherein each of said cans has a top end and a bottom end, said device comprising:

a plurality of generally ring-shaped members, wherein each of said ring-shaped members has an upper orifice and a lower orifice, said upper orifice generally conforming to the shape of the bottom end of said can for releasable retention therein, said lower orifice generally conforming to the top end of said can for releasable retention therein; and, a plurality of inner fillets which are integrally formed with said plurality of ring-shaped members, said plurality of inner fillets interconnecting said plurality of ring-shaped members in such a manner to maintain said ring-shaped members in a generally co-planar relationship to each other, whereby the insertion of a plurality of said beverage cans into the lower orifice of said plurality of said ring-shape members forms a modular building block for stacking one upon another.

2. The modular beverage can interlocking device of claim 1, wherein either said lower orifice or said upper orifice comprises at least one inwardly facing annular slot which is adapted for removable retention of either the top or bottom end of said can therein via a snap-fit.

3. A modular beverage can interlocking device adapted for releasable retention of a plurality of conventional beverage cans wherein each of said cans has a top end and a bottom end, said device comprising:

a plurality of generally ring-shaped members, wherein each of said ring-shaped members has an upper orifice and a lower orifice, said upper orifice generally conforming to the share of the bottom end of said can for releasable retention therein, said lower orifice generally conforming to the top end of said can for releasable retention therein; and, wherein either said lower orifice or said upper orifice of each of said ring-shaped members comprises;

at least two inwardly facing annular slots which is adapted for removable retention of either the top or bottom end of said can, wherein each of said inwardly facing annular slots having varying diameter; and, a plurality of inner fillets which are integrally formed with said plurality of ring-shared members, said plurality of inner fillets interconnecting said plurality of ring-shaped members in such a manner to maintain said ring-shaped members in a generally co-planar relationship to each other, whereby the insertion of a plurality of said beverage cans into the lower orifice of said plurality of said ring-shape members forms a modular building block for stacking one upon another.

4. The modular beverage can interlocking device of claim 1, wherein said lower orifice and said upper orifice comprises at least one inwardly facing annular slot, wherein said lower orifice is adapted for removable retention of the top end of said can therein and upper orfice is adapted for removable retention of the bottom end of another said can therein.

5. The modular beverage can interlocking device of claim 1, wherein said plurality of said ring-shaped members are disposed in at least one column of equally spaced linear rows, wherein said rows comprise at least two said ring-shaped members.

6. The modular beverage can interlocking device of claim 1, wherein said inner fillets are cutable by a user in order to form two smaller beverage can interlocking devices.

7. The modular beverage can interlocking device of claim 1, further comprising a plurality of outer fillets which are integrally formed with said ring-shaped members, said plurality of outer fillets are tangentially interconnected to each of said ring-shaped members thus partially forming an outer periphery of said device.

8. A modular beverage can interlocking device adapted for releasable retention of a plurality of conventional beverage cans wherein each of said cans has a top end and a bottom end, said device comprising:

a plurality of generally ring-shaped members, wherein each of said ring-shaped members has an upper orifice and a lower orifice, said upper orifice generally conforming to the shape of the bottom end of said can for releasable retention therein, said lower orifice generally conforming to the top end of said can for releasable retention therein; and, a plurality of disk-shaped membranes integrally attached around the inner periphery of each of said ring-shaped members in order to isolate and seal the contents of said plurality of cans disposed in the lower orifices thereof; and a plurality of inner fillets which are integrally formed with said plurality of ring-shaped members, said plurality of inner fillets interconnecting said plurality of ring-shaped members in such a manner to maintain said ring-shaped members in a generally co-planar relationship to each other, whereby the insertion of a plurality of said beverage cans into the lower orifice of said plurality of said ring-shape members forms a modular building block for stacking one upon another.

9. A modular beverage can interlocking device adapted for releasable retention of a plurality of conventional beverage cans wherein each of said cans has a top end and a bottom end, said device comprising:

a plurality of generally ring-shaped members, wherein each of said ring-shaped members has an upper orifice and a lower orifice, said upper orifice generally conforming to the shape of the bottom end of said can for releasable retention therein, said lower orifice generally conforming to the top end of said can for releasable retention therein; and, a plurality of disk-shaped end caps integrally attached around the periphery of either the lower orifice or the upper orifice of each said ring-shaped members, wherein each of said end caps having a hole centrally formed therein, said hole being adapted for placement of a screw therethrough; and, a plurality of inner fillets which are integrally formed with said plurality of ring-shaped members, said plurality of inner fillets interconnecting said plurality of ring-shaped members in such a manner to maintain said ring-shaped members in a generally co-planar relationship to each other, whereby the insertion of a plurality of said beverage cans into the lower orifice of said plurality of said ring-shape members forms a modular building block for stacking one upon another.

10. The modular beverage can interlocking device of claim 1, wherein said plurality of ring-shaped members, and said plurality of inner fillets are integrally formed from one piece of material.

11. The modular beverage can interlocking device of claim 10, wherein said material is thermoplastic.

12. The modular beverage can interlocking device of claim 1, wherein each of said ring-shaped members further comprises an upper portion and a lower portion; said upper portion having said upper orifice formed therein and said lower portion having said lower orifice formed therein, said upper portion and lower portion have a plurality of gaps integrally formed therein thereby increasing the relative effective pliability of the upper orifice as well as lower orifice respectively.

13. A modular beverage can interlocking device adapted for releasable retention of a plurality of conventional beverage cans, each of said cans having a top end and a bottom end, said device comprising:

a plurality of generally cylindrically-shaped members having an upper end portion and a lower end portion, wherein each said upper end portion having an upper orifice formed therein and each of said lower end portion having a lower orifice formed therein, said upper orifice generally conforming to the shape of the bottom end of said can for releasable retention therein via a snug friction-fit, either said lower orifice or said upper orifice comprises at least one inwardly facing annular slot which is adapted for removable retention of the top end of said can therein via a snap-fit; and, a plurality of inner fillets which are integrally formed with said plurality of cylindrically-shaped members, said plurality of inner fillets interconnecting said plurality of cylindrically-shaped members in such a manner to maintain said cylindrically-shaped members in a generally co-planar relationship to each other, whereby the insertion of a plurality of said beverage cans into the lower orifice of said plurality of said cylindrically-shaped members forms a modular building block for stacking one upon another.

14. A modular beverage can interlocking device adapted for releasable retention of a plurality of conventional beverage cans, each of said cans having a top end and a bottom end, said device comprising:

a plurality of generally cylindrically-shaped members having an upper end portion and a lower end portion, wherein each said upper end portion having an upper orifice formed therein and each of said lower end portion having a lower orifice formed therein, said upper orifice generally conforming to the shape of the bottom end of said can for releasable retention therein via a snug friction-fit, either said lower orifice or said upper orifice comprises at least one inwardly facing annular slot which is adapted for removable retention of the top end of said can therein via a snap-fit; and wherein either said lower orifice or said upper orifice of each of said ring-shaped members comprises;

at least two inwardly facing annular slots which is adapted for removable retention of either the top or bottom end of said can, wherein each of said inwardly facing annular slots having varying diameter; and, a plurality of inner fillets which are integrally formed with said plurality of cylindrically-shaped members, said plurality of inner fillets interconnecting said plurality of cylindrically-shaped members in such a manner to maintain said cylindrically-shaped members in a generally co-planar relationship to each other, whereby the insertion of a plurality of said beverage cans into the lower orifice of said plurality of said cylindrically-shaped members forms a modular building block for stacking one upon another.

15. The modular beverage can interlocking device of claim 13, wherein said lower orifice and said upper orifice comprises at least one inwardly facing annular slot, wherein said lower orifice is adapted for removable retention of the top end of said can therein and upper office is adapted for removable retention of the bottom end of another said can therein.

16. The modular beverage can interlocking device of claim 13, wherein said plurality of said cylindrically-shaped members are disposed in at least one column of equally spaced linear rows, wherein each of said rows comprises at least two ring-shaped members.

17. The modular beverage can interlocking device of claim 13, wherein said inner fillets are cutable by a user in order to form two smaller beverage can interlocking devices.

18. A modular beverage can interlocking device of adapted for releasable retention of a plurality of conventional beverage cans, each of said cans having a top end and a bottom end, said device comprising:

a plurality of generally cylindrically-shaped members having an upper end portion and a lower end portion, wherein each said upper end portion having an upper orifice formed therein and each of said lower end portion having a lower orifice formed therein, said upper orifice generally conforming to the shape of the bottom end of said can for releasable retention therein via a snug friction-fit, either said lower orifice or said upper orifice comprises at least one inwardly facing annular slot which is adapted for removable retention of the top end of said can therein via a snap-fit; and;

a plurality of disk-shaped end caps integrally attached around the periphery of either the lower orifice or the upper orifice of each said cylindrically-shaped members, each of said end caps having a hole centrally formed therein, said hole being adapted for placement of a screw therethrough; and, a plurality of inner fillets which are integrally formed with said plurality of cylindrically-shaped members, said plurality of inner fillets interconnecting said plurality of cylindrically-shaped members in such a manner to maintain said cylindrically-shaped members in a generally co-planar relationship to each other, whereby the insertion of a plurality of said beverage cans into the lower orifice of said plurality of said cylindrically-shaped members forms a modular building block for stacking one upon another.

19. The modular beverage can interlocking device of claim 13, wherein said plurality of cylindrically-shaped members and said plurality of inner fillets are integrally formed from one piece of material.

20. The modular beverage can interlocking device of claim 19, wherein said material is thermoplastic.

21. The modular beverage can interlocking device of claim 13, wherein the upper portion and lower portion of each of said cylindrically-shaped members have a plurality of gaps integrally formed therein thereby increasing the relative effective pliability of the upper orifice as well as lower orifice respectively.

22. A modular beverage can interlocking device adapted for releasable retention of a plurality of conventional beverage cans wherein each of said cans has a top end and a bottom end, said device comprising:

a plurality of generally cylindrically-shaped members having an upper end portion and a lower end portion, wherein each of said upper end portion having an upper orifice formed therein and each of said lower end portion having a lower orifice formed therein, said upper orifice generally conforming to the shape of the bottom end of said can for releasable retention therein, said lower orifice generally conforming to the top end of said can for releasable retention therein;

a plurality of inner fillets which are integrally formed with said plurality of ring-shaped members, said plurality of inner fillets interconnecting said plurality of ring-shaped members in such a manner to maintain said ring-shaped members in a generally co-planar relationship to each other, whereby the insertion of a plurality of said beverage cans into the lower orifice of said plurality of said ring-shape members forms a modular building block for stacking one upon another; and, a plurality of gaps formed on the upper portion and lower portion of each of said cylindrically-shaped members, thereby increasing the relative effective pliability of the upper orifice as well as lower orifice respectively.

23. A modular can interlocking device comprising plural thermoplastic annular means for holding plural cans, (1) each annular means for holding plural cans having an annular inner wall defining an orifice through the annular device, the inner annular wall having a lower portion and an upper portion, (a) the lower portion of the inner annular wall having a single indentation formed annularly in the lower portion of the inner annular wall, the indentation in the lower portion of the inner annular wall being sized to releasably secure an upper annular ring of a first can when the can ring is inserted into the indentation, (b) the upper portion of the inner annular wall of the annular device being sized and shaped to releasably secure the bottom portion of a second can by means of a snug friction-fit, and (2) the plural annular means for holding plural cans being arranged in a planar relationship with adjacent annular means for holding plural cans being connected by a fillet.

24. The modular can interlocking device of claim 23 wherein the plural annular means for holding plural cans and the fillets are all formed in a unitary piece of thermoplastic material.

25. A modular can interlocking device comprising plural thermoplastic annular means for holding plural cans, (1) each annular means for holding plural cans having an annular inner wall defining an orifice through the annular device, the inner annular wall having a lower portion and an upper portion, (a) the lower portion of the inner annular wall having plural indentations formed annularly in the lower portion of the inner annular wall, (i) the lowest indentation in the lower portion of the inner annular wall being sized to releasably secure an upper annular ring of a first can when the first can is inserted into the indentation, and (ii) each of the next at least one next higher indentation in the lower portion of the inner annular wall being sized to releasably secure an upper annular ring of the first can when the first can is inserted past the lower indentation(s) and into the next higher indentation, and (iii) wherein the lowest indentation has the largest circumference and each progressively higher indentation has a progressively smaller circumference, (b) the upper portion of the inner annular wall of the annular device being sized and shaped to releasably secure the bottom portion of a second can by means of a snug friction-fit, and (2) the plural annular means for holding plural cans being arranged in a planar relationship with adjacent annular means for holding plural cans being connected by a fillet.

26. The modular can interlocking device of claim 25 wherein the plural annular means for holding plural cans and the fillets are all formed in a unitary piece of thermoplastic material.

27. A modular can interlocking device comprising plural thermoplastic annular means for holding plural cans, (1) each annular means for holding plural cans having an annular inner wall, the inner annular wall having a lower portion and an upper portion, (a) each annular means for holding plural cans having a diaphragm disposed across the annular means above the lower portion, (b) the lower portion of the inner annular wall having a single indentation formed annularly in the lower portion of the inner annular wall, the indentation in the lower portion of the inner annular wall being sized to releasably secure an upper annular ring of a first can when the can ring is inserted into the indentation, (c) the upper portion of the inner annular wall of the annular device being sized and shaped to releasably secure the bottom portion of a second can by means of a snug friction-fit, and (2) the plural annular means for holding plural cans being arranged in a planar relationship with adjacent annular means for holding plural cans being connected by a fillet.

28. A modular can interlocking device comprising plural thermoplastic annular means for holding plural cans, (1) each annular means for holding plural cans having an annular inner wall which has a single indentation sized and shaped to releasably secure both the top portion of a first can and the bottom portion of a second can disposed above the first can, and (2) the plural annular means for holding plural cans being arranged in a planar relationship with adjacent annular means for holding plural cans being connected by a fillet.

29. The modular can interlocking device of claim 28 wherein the top of the first can and the bottom of the second can are butted together when the top portion of the first can and the bottom portion of the second can are secured in the indentation of the inner wall of an annular means.

30. A modular can interlocking device comprising:

(1) plural rings each comprising plural tab means for holding two cans one on top of the other, the plural tab means arranged in the shape of a ring, with each tab means connected to its neighbor in the ring by a first fillet, (ii) each tab means for holding two cans comprising a lower portion for holding the lower can, having an inner side arranged to face the lower can, the inner side of the lower portion of each tab means having a linear concavity in the side that is dimensioned to releasably hold a top ring of the lower can, (ii) each tab means for holding two cans further comprising an upper portion being shaped and dimensioned to releasably hold the bottom portion of the upper can, (2) each of the plural rings arranged in a generally planar relationship with the plural rings connected together by second fillets with a second fillet connecting each of the plural rings to its immediate neighbors.

31. A modular can interlocking device comprising:

(1) plural rings each comprising plural tab means for holding an end ring of a can, the plural tab means arranged in the shape of a ring, with each tab means connected to its neighbor in the ring by a first fillet, each tab means for holding the end ring of a can having an inner side arranged to face the can, the inner side having a linear concavity in the side that is dimensioned to releasably hold the top ring of the can, (2) each of the plural rings arranged in a generally planar relationship with the plural rings connected together by second fillets with a second fillet connecting each of the plural rings to its immediate neighbors.

32. A modular can interlocking device comprising:

(1) plural rings each comprising plural tab means for holding two cans one on top of the other, the plural tab means arranged in the shape of a ring, with each tab means connected to its neighbor in the ring by a first fillet, (ii) each tab means for holding two cans comprising a upper portion for holding the upper can, the upper portion having an inner side arranged to face the lower can, the inner side of the upper portion of each tab means having a linear concavity in the side that is dimensioned to releasably hold a bottom ring of the upper can, (ii) each tab means for holding two cans further comprising a flexible lip extending radially inward from the inner side of the tab means, the flexible lip being shaped and dimensioned to releasably hold the top ring of the lower can, (2) each of the plural rings arranged in a generally planar relationship with the plural rings connected together by second fillets with a second fillet connecting each of the plural rings to its immediate neighbors.

33. The modular can interlocking device of claim 23 wherein said indentations provide circumferential support for the side wall of said plural cans.

34. The modular beverage can interlocking device of claim 1, wherein said lower orifice aiid said upper orifice comprises a deformable annular recess, each deformable annular recess generally conforming to either the top or the bottom end of said beverage can for releasable retention therein, and wherein each said annular recess provides circumferential support for the side wall of said beverage can.

* * * * *